US006980107B1

(12) United States Patent
Ziegler

(10) Patent No.: US 6,980,107 B1
(45) Date of Patent: Dec. 27, 2005

(54) AUDIO VISUAL DISPLAY SYSTEM FOR USE AT AN INTERMENT OR MEMORIAL SITE

(76) Inventor: Mitchell Ziegler, 2081 Hartel St., Levittown, PA (US) 19057

( * ) Notice: Subject to any disclaimer, the term of this patent is extended or adjusted under 35 U.S.C. 154(b) by 0 days.

(21) Appl. No.: 10/200,942

(22) Filed: Jul. 23, 2002

(51) Int. Cl.[7] ..... G08B 21/00
(52) U.S. Cl. ..... 340/540; 540/541
(58) Field of Search ..... 340/540, 815.4, 340/384.1, 541; 40/124.5; 369/20

(56) References Cited

U.S. PATENT DOCUMENTS

| | | | |
|---|---|---|---|
| D310,419 | S | 9/1990 | Morvant |
| 5,404,343 | A | 4/1995 | Boggio |
| 5,564,816 | A | 10/1996 | Arcadia et al. |
| D381,182 | S | 7/1997 | Whited |
| 5,687,515 | A | 11/1997 | Rodrigues et al. |
| 5,696,488 | A | 12/1997 | Assisi |
| 5,729,921 | A | 3/1998 | Rojas |
| 6,006,645 | A | 12/1999 | Weiss |
| 6,088,973 | A | 7/2000 | Weiss |
| 6,094,871 | A | 8/2000 | Arnold et al. |
| 6,145,672 | A | 11/2000 | Bachman et al. |
| 2001/0036354 | A1 * | 11/2001 | Majors ..... 386/34 |

* cited by examiner

*Primary Examiner*—Julie Lieu
(74) *Attorney, Agent, or Firm*—Sperry, Zoda & Kane

(57) ABSTRACT

An audio visual display system for use positioned at a site of interment such as a cemetery or grave site to provide information to users specifically pertinent to the aspect of memorialization of the site of interment and, in particular, of the individual or individuals buried at this location. The design includes an audio visual displaying device for displaying visual information and playing audio information commemorating the interment site or otherwise pertinent thereto. An input selection means such as a keyboard or touchpad is included for selecting among more than one possible audio and/or visual display modes. A self-contained power supply system is included with an optional solar cell recharging system. The system is completely self-contained and is self-sustained at the site with its own power supply and security system allowing both maintenance and secure access thereto by users. The system includes a monitoring means for indicating malfunctions preferably at remote locations through a cellular transmission device. The entire system is hermetically sealed relative to the external ambient environment to maximize security and minimize maintenance requirements.

20 Claims, 3 Drawing Sheets

AUDIO VISUAL DISPLAY SYSTEM FOR USE AT AN INTERMENT OR MEMORIAL SITE

BACKGROUND OF THE INVENTION

1. Field of the Invention

The present invention deals with the field of devices most generally for memorializing burial sites normally located in cemeteries. Normally one or more individuals are interred at a specific site and the present invention provides audio and visual information as well as a displaying and playing means therefore at the site. The present invention deals with that field of fixtures which are designed to be positionable at interment sites to generally commemorate or any manner memorialize the life of the individual or individuals to which the interment site specifically relates. Use of this design in non-human interment locations is contemplated such as at places of pet burial.

2. Description of the Prior Art

The prior art includes a number of devices or constructions or systems for the purpose of memorializing an interment site for a human or other being such as U.S. Des. Pat. No. D310,419 issued Sep. 4, 1990 to A. J. Morvant on a "Permanent Photographic Memorial Marker"; and U.S. Pat. No. 5,404,343 issued Apr. 4, 1995 to B. M. Boggio on a "Resting Place Marker With Audio System"; and U.S. Pat. No. 5,564,816 issued Oct. 15, 1996 to A. J. Arcadia et al on an "Illuminated Memorial Assembly"; and U.S. Des. Pat. No. D381,182 issued Jul. 15, 1997 to R. C. Whited on a "Horizontal Grave Marker"; and U.S. Pat. No. 5,687,515 issued Nov. 18, 1997 to R. W. Rodrigues on a "Monument Display Case And Mounting Assembly"; and U.S. Pat. No. 5,696,488 issued Dec. 9, 1997 to R. Assisi on a "Device For Storage And Retrieval Of Personal Information"; and U.S. Pat. No. 5,729,921 issued Mar. 24, 1998 to J. L. Rojas on a "Burial Marker And Display Box"; and U.S. Pat. No. 6,006,458 issued Dec. 28, 1999 to H. Weiss on "Monuments, Markers And Columbariums With Improved Display Indicia"; and U.S. Pat. No. 6,088,973 issued Jul. 18, 2000 to H. Weiss on "Monuments, Markers And Columbariums With Improved Display Indicia"; and U.S. Pat. No. 6,092,330 issued Jul. 25, 2000 to R. Pratt on a "Memorial Year Round Flower Display"; and U.S. Pat. No. 6,094,871 issued Aug. 1, 2000 to F. J. Arnold et al and assigned to Arnold Systems Corporation, Inc. on a "Headstone Display Assembly"; and U.S. Pat. No. 6,145,672 issued Nov. 14, 2000 to D. E. Bachman and assigned to The York Group, Inc. on a "Memorial Display Unit And Method For Displaying Memorials".

SUMMARY OF THE INVENTION

The present invention provides an audio visual display system for use at an interment site for the purpose of providing various types of information specifically pertinent to the site to any user who physically visits the site. The site can be a site of memorialization of any individual such as a human or animal such as a pet.

The system includes an audio visual playing means which is capable of playing audio information and/or displaying visual information at the interment site which is specifically pertinent to the individual or individuals to which the interment site directly relates. This audio visual playing means can include a liquid crystal display device or other visual displaying means for displaying of stored video information. Similarly a speaker system can be included to facilitate playing of audio information of various sorts communicated to the audio visual playing means.

An information storage means is included for retaining audio and visual information at the interment site specifically pertinent to the person or persons to which the site relates. This information storage device is operatively connected to the audio visual playing means for the purpose of transmitting selected information thereto for playing audibly or displaying visually. Preferably the information storage device can include an electronic computer controlled magnetic storage medium such as a conventional magnetic stored hard disk or removable floppy disk or other similar storage device. Also however the storage medium can be any selectively retrievable means of storage possible made available by existing or developing technology.

An input selection device will be included in the audio visual display system of the present invention which preferably will comprise some type of keypad which can be a manually depressible keypad or could be a touch screen. This input selection means is preferably located at the interment site and is operatively connected to the information storage means for the purpose of allowing communication with the audio visual display system by persons who are indicated to the system as being authorized. The input selection means can preferably be operated by authorized persons such that they can choose which audio and visual information contained within the information system is to be conveyed to the audio visual playing means and thereby exposed to the user. Alternatively the input selection means can be used to provide access to the audio visual display system by maintenance personnel.

The audio visual display system of the present invention will include a power supply means which is positioned at the interment site and is operatively connected with respect to the audio visual display system for facilitating powering of the individual components thereof. This power supply means will preferably include some type of a battery which provides electrical power to the individual components of the audio visual display system. This battery could be a lithium battery, a fuel cell, a conventional lead acid battery or a gel cell battery.

A solar cell means may be operatively connected to the power supply means to facilitate charging thereof responsive to the solar cell being exposed to solar radiation in order to maximize the life expectancy of the power supply means and maintain it in a fully charged condition.

The system of the present invention further includes a security means which is operatively attached to the audio visual display system for the purpose of preventing unauthorized access thereto. This security device also may be operative responsive to vandalism sensed at the interment site to generate a vandalism alarm signal at a remote location for the purpose of summoning security personnel to the interment site.

A security usage authorization means may also be operatively connected to the security means of the audio visual display system of the present invention for the specific purpose of selectively overriding the security means in order to allow authorized access to the input selection device for operation of the audio visual system. The security usage authorization means will require the entry normally of a personal identification number by a user through the input selection means. The security usage authorization means is also responsive to the entry of such a personal identification number or PIN to provide a user with a selection menu provided by the audio visual playing means for the purpose of allowing the user to choose among multiple display options.

A security maintenance authorization device may also be included in the present invention which is operatively connected to the security means for overriding it. This overriding is for the purpose of selectively providing authorized access to the audio visual display system for repair and maintenance personnel. The security maintenance authorization device also requires the entry of a maintenance identification code through the input selection means in order to provide access to the audio visual display system for maintenance.

The present invention may further include a system monitoring means which is operatively connected to the audio visual display system for the purpose of monitoring the operating conditions of the overall system and of the individual components thereof. This system monitoring device will preferably include a malfunction alarm which is activated responsive to the existence of a malfunction for the purpose of sensing the presence of such a malfunction.

The entire system is preferably sealed by a sealing means which extends around all components for the purpose of hermetically sealing the entire system and all components thereof from the external ambient environment to enhance security thereof and to minimize deterioration thereof which can be caused by external weather conditions normally experienced with externally placed electronic equipment. Furthermore the present invention may include a cellular telephone remote alarming means for the purpose of transmitting alarm information and other information regarding the conditions of the overall audio visual display system from the security means to a remote location for monitoring thereof and possibly summoning personnel as may be deemed necessary.

It is an object of the audio visual display system for use at an interment site to provide information to the user specifically pertinent to the site wherein both audio and visual information can be displayed.

It is an object of the audio visual display system for use at an interment site to provide information to the user specifically pertinent to the site wherein both audio and visual information can be selected from a large storage source of such information for selective display thereof.

It is an object of the audio visual display system for use at an interment site to provide information to the user specifically pertinent to the site which include a liquid crystal display for showing visual information.

It is an object of the audio visual display system for use at an interment site to provide information to the user specifically pertinent to the site which includes a speaker device for showing playing audio information.

It is an object of the audio visual display system for use at an interment site to provide information to the user specifically pertinent to the site which can include a keypad as an input selection device for controlling operation of the overall system.

It is an object of the audio visual display system for use at an interment site to provide information to the user specifically pertinent to the site which includes a battery power supply which can include a means for solar charging thereof by the inclusion of a solar cell.

It is an object of the audio visual display system for use at an interment site to provide information to the user specifically pertinent to the site which includes a security means for controlling access by users.

It is an object of the audio visual display system for use at an interment site to provide information to the user specifically pertinent to the site which includes a security maintenance authorization system for controlling access to the system for maintenance thereof.

It is an object of the audio visual display system for use at an interment site to provide information to the user specifically pertinent to the site which includes a system monitoring device for monitoring any malfunction of any component of the overall system.

It is an object of the audio visual display system for use at an interment site to provide information to the user specifically pertinent to the site which is hermetically sealed with respect to the external ambient environment.

It is an object of the audio visual display system for use at an interment site to provide information to the user specifically pertinent to the site which may include a cellular telephone remote communication means for transmitting information regarding the conditions of the audio visual system to a remote location.

It is an object of the audio visual display system for use at an interment site to provide information to the user specifically pertinent to the site which is completely self-contained and self-sustained.

It is an object of the audio visual display system for use at an interment site to provide information to the user specifically pertinent to the site which includes personalized coded access to operation and maintenance and re-setting of any alert alarm systems.

It is an object of the audio visual display system for use at an interment site to provide information to the user specifically pertinent to the site which provides selective retrieval of pre-recorded audio or visual information appropriate to the site.

It is an object of the audio visual display system for use at an interment site to provide information to the user specifically pertinent to the site which provides continuous and uninterrupted communication to security monitor services of real time alerts generated by a, monitoring device.

It is an object of the audio visual display system for use at an interment site to provide information to the user specifically pertinent to the site which continuously monitors power sources, general operating condition of all devices, intrusion detection and site vandalism or destruction conditions.

It is an object of the audio visual display system for use at an interment site to provide information to the user specifically pertinent to the site which has the flexibility to update or modify pre-recorded information, life scenes, messages or communications.

It is an object of the audio visual display system for use at an interment site to provide information to the user specifically pertinent to the site which is usable with a continuous uninterruptable self-renewed environmentally safe self-contained power source which is rechargeable.

It is an object of the audio visual display system for use at an interment site to provide information to the user specifically pertinent to the site which can be powered by various types of power sources including gel cell batteries, lithium batteries, fuel cells or lead acid batteries or other types.

It is an object of the audio visual display system for use at an interment site to provide information to the user specifically pertinent to the site which can be usable for various types of interment sites such as upright tombstones, landscape or horizontal monuments, upright support displays, celebrity memorial displays, mausoleum displays, cremation displays or any cemetery stand-alone display.

It is an object of the audio visual display system for use at an interment site to provide information to the user specifically pertinent to the site which can be usable i for various types of memorial sites such as individual burial sites of humans or animals.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
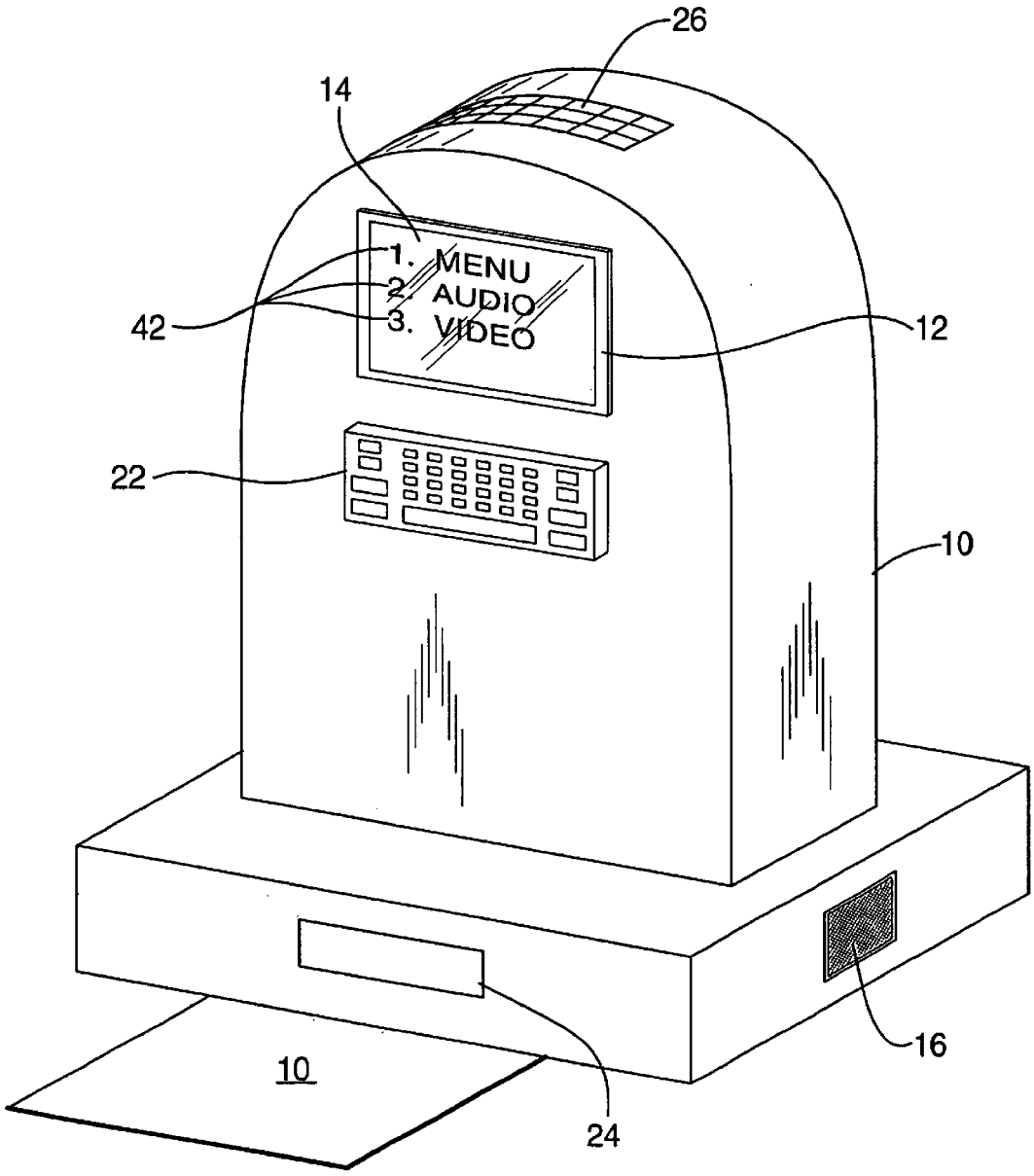
FIG. 1 is a perspective illustration of an embodiment of the present invention showing an interment site with an embodiment of the audio visual display system at this location.
Figure 2:
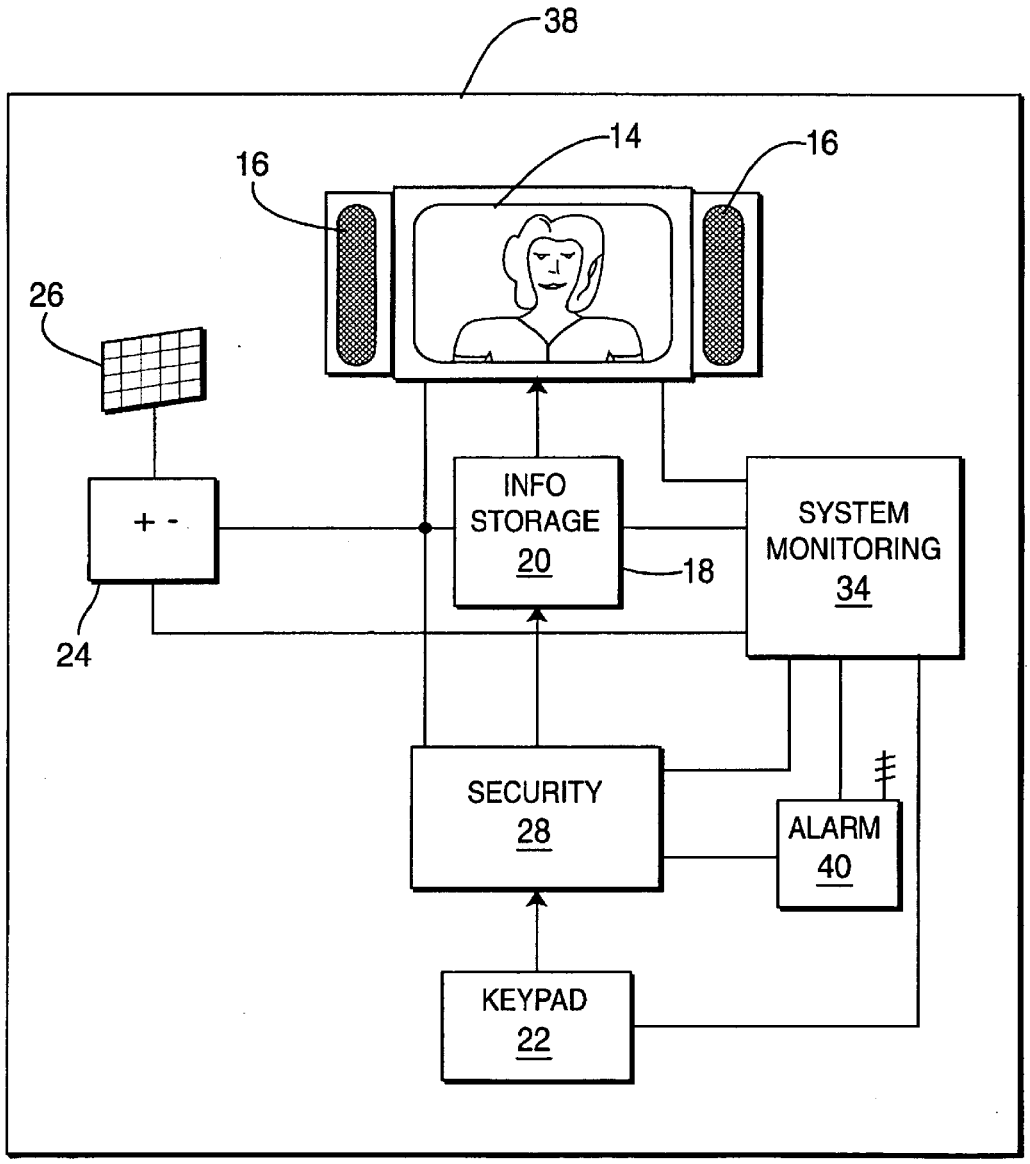
FIG. 2 is a schematic system analytical diagram showing the various components of an embodiment of the audio visual display system of the present invention which is adapted to be positioned at an interment or memorial site to provide information to a user specifically appropriate to the site.
Figure 3:
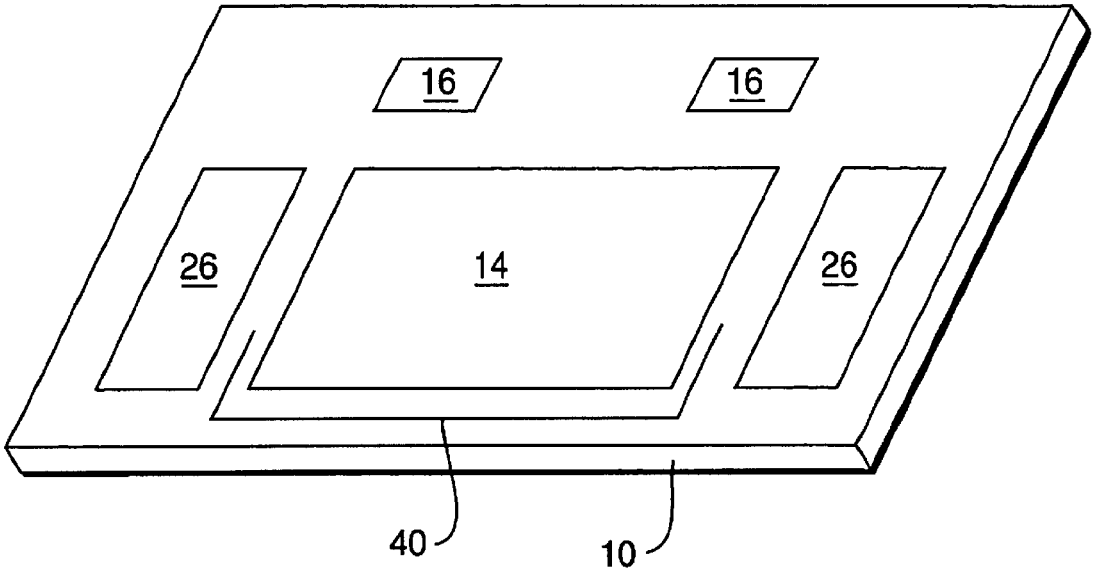
FIG. 3 is a perspective illustration of another embodiment of the present invention showing an audio visual display system configured to be positioned approximately flush with a surrounding subterranean memorial site.

The present invention provides an audio visual display means for use at an interment or memorial site 10 to provide information to a user specifically appropriate to the site. Preferably the audio visual display system includes an audio visual playing means 12 which can include a component for displaying of the visual information such as a liquid crystal display device or screen 14. Also the audio visual playing means 12 can include an audio playing means such as speaker means 16. In this manner the audio and visual aspects of the information stored within an information storage means 18 can be conveyed to a user at the interment site 10. The information storage means 18 can be any one of a great variety of difference information storage systems which are selectively retrievable such as flash ram, flash memory, magnetic tapes, disks, compact disks, DVDs, electronic chips, RAM, ROM etc.

The information storage means 18 preferably provides a means for storing of any type of audio or visual information at an electronic computer controlled magnetic storage medium 20. The information so stored can be selected for displaying or playing of particular audio or visual information through the playing means 12 and, in particularly, through the liquid crystal display device 14 or the speaker 16. It should be appreciated that the audio information can be conveyed through other audio playing means than speaker 16. It should also be appreciated that the visual information can be displayed through other devices other than liquid crystal display device 14. However, the use of liquid crystal display device 14 and speakers 16 is the preferred mode set forth in this specific embodiment but in no way means to limit the inclusion of various audio or visual playing or displaying devices usable with the present invention.

In order to provide access to the computer controlled magnetic storage medium 20, an input selection means 22 such as a keyboard can be included operatively connected to the information storage means 18 and the liquid crystal display device 14 and the other components of the audio visual display system of the present invention. This input selection means 22 can be a conventional depressible keyboard or could be a touch screen. Such touch screens are more easily maintained and facilitate hermetically sealing of the system with respect to the external environment. The present invention is protected by a sealing means 18 hermetically with respect to the external environment in order to minimize deterioration of the components of the audio visual display system when subjected to the ambient environmental conditions such as weather and extreme temperatures and the like.

The present invention also includes a power supply means 24 such as a battery which is operatively secured to each component of the audio visual display system for electrical powering thereof. A solar cell charging device 26 is preferably positioned also at the interment site 10 for the purpose of charging the power supply means 24 and maintaining it in a fully charged condition at any time when the solar cell charging means 26 is exposed to solar radiation.

A security means 28 is included for limiting access to the audio visual display system and, in particulary, through the input selection keyboard 22. This security means 28 can provide personal identification numbers such that access to operation of the audio visual display system is achieved through a security usage authorization means which limits access thereto other than when the personal identification number or PIN is properly entered through the keyboard 22. Similarly access to the audio visual display system is limited by the security means 26 unless a maintenance identification code is entered such that a security maintenance authorization means within the security means 28 will provide access to the system for maintenance of any component therein.

A system monitoring means 34 will monitor all components of the audio visual display system and has the capability of generating a malfunction alarm through the malfunction alarm means 36 thereof whenever a parameter or condition of a component is outside of pre-defined limits. Thus the existence of a malfunction can be communicated to a remote location to summon maintenance personnel when desired.

Communication between the audio visual display system at remote locations is achievable by the inclusion of a cellular telephone remote alarming device 40 which is capable of communicating remotely from the interment site to a remote location for summoning personnel for maintenance as well as responding to vandalism or other malfunctioning aspects of individual components or of the audio visual display system in its entirety.

The audio visual playing means 12 is capable of providing a menu 42 for facilitating operation of the audio visual display system at the interment site 10 or for facilitating maintenance thereof. This menu 42 can be displayed visually by a visual displaying means such as the liquid crystal display device 14. Alternatively the menu can be played audibly through the speaker means 16 or other audio generating device. These menus will normally comprise a selection of which material within the information storage means 18 will be displayed or played by the audio visual playing means 16 in response to the entry of a user's personal identification number 30 through the input keyboard 22. Also the input keyboard device 22 can be used for entering a maintenance identification code in accordance with the security maintenance authorization means 32 which is a portion of the security means 28 which allows access to various aspects of the audio visual display system by maintenance personnel for servicing or maintenance thereof.

It is important to appreciate that the present invention provides an audio visual display system which is completely self-contained for the display of audio visual information at an interment site wherein the system is fully self-sustained and has complete site security. With the device as shown in this embodiment the personalized coded access is provided with a limited access security keypad or panel or activated touch screen. In this manner pre-established codes can be used to activate the system or provide maintenance or for other operation thereof and these codes can be changed periodically as may be needed.

This system provides a means of commemorating an interment site wherein individuals can select from a series of menu choices to individually or completely retrieve audio visual information residing at the interment site 10 in order to display various information such as pre-recorded life scenes, audio visual messages appropriate to the site resident, as well as generic specific religious or secular audio visual messages or communications otherwise appropriate to the site.

This site includes a continuous and uninterrupted source of power through the power supply means 24. Conventional solar charging devices can be connected to pre-existing and readily available rechargeable power storage devices of various types such as gel cell batteries, lithium batteries, fuel cells or lead acid batteries or other types of power supplies.

Although it is contemplated that the present invention will be used for human burial locations, it is entirely possible to use a similar apparatus as any memorial or interment location celebrating the life of any individual human or animal lifeform. Also, the site can be the actual site of interment or can be a memorial site memorializing the life of any individual human or animal lifeform.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An audio visual display system for use at a memorial site to provide information to a user specifically pertinent to the site comprising:

A. an audio visual playing means capable of playing audio information and displaying visual information at a memorial site which is specifically pertinent thereto;

B. an information storage means for retaining audio and visual information at the interment site specifically pertinent thereto and being operatively connected to said audio visual playing means for transmitting selected information thereto;

C. an input selection means located at the interment site and operatively connected to said information storage means for allowing communication with the audio visual display system by authorized persons;

D. a power supply means positioned at the interment site and being operatively connected with respect to said audio visual display system for powering thereof;

E. a security means at the interment site which is operatively attached to the audio visual display system to prevent unauthorized access thereto;

F. a security usage authorization means operatively connected to said security means for selective overriding thereof in order to provide authorized access to said input selection means for operation of the audio visual display system; and G. a security maintenance authorization means operatively connected to said security means for overriding thereof in order to selectively provide authorized access to said audio visual display system for repair and maintenance thereof.

2. An audio visual display system for use at a memorial site to provide information to a user specifically pertinent to the site as defined in claim 1 wherein said power supply means comprises a battery means for providing electrical power to said audio visual display system.

3. An audio visual display system for use at a memorial site to provide information to a user specifically pertinent to the site as defined in claim 2 further comprising a solar cell means operatively connected to said power supply means for charging thereof responsive to said solar cell means being exposed to solar radiation.

4. An audio visual display system for use at a memorial site to provide information to a user specifically pertinent to the site as defined in claim 1 further comprising a system monitoring means operatively connected to the audio visual display system for monitoring the operating conditions thereof and generating malfunction signals responsive to monitored conditions being outside of predefined parameter operating limits.

5. An audio visual display system for use at a memorial site to provide information to a user specifically pertinent to the site as defined in claim 1 wherein said security maintenance authorization means requires entry of a maintenance identification code through said input selection means for providing access to the audio visual display system for maintenance thereof.

6. An audio visual display system for use at a memorial site to provide information to a user specifically pertinent to the site as defined in claim 4 wherein said system monitoring means includes a malfunction alarm means which is activated responsive to the existence of a malfunction in operation of the audio visual display system.

7. An audio visual display system for use at a memorial site to provide information to a user specifically pertinent to the site as defined in claim 1 wherein said security usage authorization means requires entry of a personal identification number by a user through said input selection means.

8. An audio visual display system for use at a memorial site to provide information to a user specifically pertinent to the site as defined in claim 7 wherein entry of the personal identification number provides a user with a selection menu provided by said audio visual playing means to allow the user to choose among a plurality of different display options.

9. An audio visual display system for use at a memorial site to provide information to a user specifically pertinent to the site as defined in claim 1 wherein said input selection means is operative by authorized persons to choose which audio and visual information contained by said information storage means is to be conveyed therefrom to said audio visual playing means.

10. An audio visual display system for use at a memorial site to provide information to a user specifically pertinent to the site as defined in claim 8 wherein the menu provided is displayed visually on said audio visual playing means.

11. An audio visual display system for use at a memorial site to provide information to a user specifically pertinent to the site as defined in claim 8 wherein the menu provided is played audibly by said audio visual playing means.

12. An audio visual display system for use at a memorial site to provide information to a user specifically pertinent to the site as defined in claim 1 wherein said audio visual playing means includes a liquid crystal display device and a speaker means to facilitate playing and displaying of audio visual information therewith.

13. An audio visual display system for use at a memorial site to provide information to a user specifically pertinent to the site as defined in claim 1 wherein said information storage means includes an electronic computer controlled magnetic storage medium.

14. An audio visual display system for use at a memorial site to provide information to a user specifically pertinent to the site as defined in claim 1 wherein said input selection means comprises a manually depressible keypad device.

15. An audio visual display system for use at a memorial site to provide information to a user specifically pertinent to the site as defined in claim 6 wherein said malfunction alarm means is operative to signal at a remote location in order to summon maintenance personnel.

16. An audio visual display system for use at a memorial site to provide information to a user specifically pertinent to the site as defined in claim 1 wherein said security means is operative responsive to vandalism at the interment site to generate an vandalism alarm signal at a remote location to summon security personnel.

17. An audio visual display system for use at a memorial site to provide information to a user specifically pertinent to the site as defined in claim 1 further comprising a sealing means extending around the audio visual display system for hermetically sealing thereof with respect to the external ambient environment.

18. An audio visual display system for use at a memorial site to provide information to a user specifically pertinent to the site as defined in claim 1 further including a cellular telephone remote alarming means in order to transmit information regarding the conditions of the audio visual display system to a remote location.

19. An audio visual display system for use at a memorial site to provide information to a user specifically pertinent to the site comprising:

A. an audio visual playing means capable of playing audio information and displaying visual information at a memorial site which is specifically pertinent thereto, said audio visual playing means including a liquid crystal display device and a speaker means to facilitate playing and displaying of audio visual information therewith;

B. an information storage means for retaining audio and visual information at the interment site specifically pertinent thereto and being operatively connected to said audio visual playing means for transmitting selected information thereto;

C. an input selection means comprising a manually depressible keypad device located at the interment site and operatively connected to said information storage means for allowing communication with the audio visual display system by authorized persons;

D. a power supply means positioned at the interment site and being operatively connected with respect to said audio visual display system for powering thereof, said power supply means comprises a battery means for providing electrical power to said audio visual display system;

E. a security means operatively attached to the audio visual display system to prevent unauthorized access thereto;

F. a security usage authorization means operatively connected to said security means for selective overriding thereof in order to provide authorized access to said input selection means for operation of the audio visual display system;

G. a security maintenance authorization means operatively connected to said security means for overriding thereof in order to selectively provide authorized access to said audio visual display system for repair and maintenance thereof;

H. a solar cell means operatively connected to said power supply means for charging thereof responsive to said solar cell means being exposed to solar radiation;

I. a system monitoring means operatively connected to the audio visual display system for monitoring the. operating conditions thereof and generating malfunction signals responsive to monitored conditions being outside of predefined parameter operating limits, said system monitoring means including a malfunction alarm means activated responsive to the existence of a malfunction in operation of the audio visual display system, said malfunction alarm means being operative to signal at a remote location in order to summon maintenance personnel; and J. a sealing means extending around the audio visual display system for hermetically sealing thereof with respect to the external ambient environment.

20. An audio visual display system for use at a memorial site to provide information to a user specifically pertinent to the site comprising:

A. an audio visual playing means capable of playing audio information and displaying visual information at a memorial site which is specifically pertinent thereto, said audio visual playing means including a liquid crystal display device and a speaker means to facilitate playing and displaying of audio visual information therewith;

B. an information storage means for retaining audio and visual information at the interment site specifically pertinent thereto and being operatively connected to said audio visual playing means for transmitting selected information thereto, said information storage means including an electronic computer controlled magnetic storage medium;

C. an input selection means comprising a manually depressible keypad device located at the interment site and operatively connected to said information storage means for allowing communication with the audio visual display system by authorized persons, said input selection means being operative by authorized persons to choose which audio and visual information contained by said information storage means is to be conveyed therefrom to said audio visual playing means;

D. a power supply means positioned at the interment site and being operatively connected with respect to said audio visual display system for powering thereof, said power supply means comprises a battery means for providing electrical power to said audio visual display system;

E. a security means operatively attached to the audio visual display system to prevent unauthorized access thereto, said security means also being operative responsive to vandalism at the interment site to generate an vandalism alarm signal at a remote location to summon security personnel;

F. a security usage authorization means operatively connected to said security means for selective overriding thereof in order to provide authorized access to said input selection means for operation of the audio visual display system, said security usage authorization means requiring entry of a personal identification number by a user through said input selection means, said security usage authorization means being responsive to entry of a personal identification number to provide a user with a selection menu provided by said audio visual playing means to allow the user to choose among a plurality of different display options;

G. a security maintenance authorization means operatively connected to said security means for overriding thereof in order to selectively provide authorized access to said audio visual display system for repair and maintenance thereof, said security maintenance authorization means requiring entry of a maintenance identification code through said input selection means for providing access to the audio visual display system for maintenance thereof;

H. a solar cell means operatively connected to said power supply means for charging thereof responsive to said solar cell means being exposed to solar radiation;

I. a system monitoring means operatively connected to the audio visual display system for monitoring the operating conditions thereof and generating malfunction signals responsive to monitored conditions being outside of predefined parameter operating limits, said system monitoring means including a malfunction alarm means activated responsive to the existence of a malfunction in operation of the audio visual display system;

J. a sealing means extending around the audio visual display system for hermetically sealing thereof with respect to the external ambient environment; and K. a cellular telephone remote alarming means for transmitting alarm information regarding the conditions of the audio visual display system from said security means to a remote location.

* * * * *